US009675223B2

(12) United States Patent
Egan et al.

(10) Patent No.: US 9,675,223 B2
(45) **Date of Patent: *Jun. 13, 2017**

(54) VACUUM CLEANER FLOOR SEAL

(71) Applicant: MIDEA AMERICA CORPORATION, Parsippany, NJ (US)

(72) Inventors: Martin Shawn Egan, Ballwin, MO (US); Donald Davidshofer, Mount Holly, NC (US); Thomas Josefsson, Bloomington, IL (US)

(73) Assignee: MIDEA AMERICA, CORP., Parsippany, NJ (US)

( * ) Notice: Subject to any disclaimer, the term of this patent is extended or adjusted under 35 U.S.C. 154(b) by 318 days.

This patent is subject to a terminal disclaimer.

(21) Appl. No.: 14/507,193

(22) Filed: Oct. 6, 2014

(65) Prior Publication Data

US 2015/0135477 A1 May 21, 2015

Related U.S. Application Data

(63) Continuation of application No. 13/324,498, filed on Dec. 13, 2011, now Pat. No. 8,904,595.

(51) Int. Cl.

| | |
|---|---|
| ***A47L 9/02*** | (2006.01) |
| ***A47L 5/30*** | (2006.01) |
| ***A47L 9/04*** | (2006.01) |

(52) U.S. Cl.

CPC *A47L 9/02* (2013.01); *A47L 5/30* (2013.01); *A47L 9/0477* (2013.01)

(58) Field of Classification Search

CPC ..... A47L 9/02; A47L 9/242; A47L 7/0009; A47L 9/0613; A47L 5/30; A47L 9/0477; A47L 9/06

See application file for complete search history.

(56) References Cited

U.S. PATENT DOCUMENTS

| | | | |
|---|---|---|---|
| 3,100,907 | A | 8/1963 | Schwertl |
| 3,654,662 | A | 4/1972 | Bates |

(Continued)

FOREIGN PATENT DOCUMENTS

| | | |
|---|---|---|
| CN | 102264268 | 11/2011 |
| DE | 202008010134 | 12/2009 |
| EP | 1075816 | 2/2001 |

OTHER PUBLICATIONS

Third Party submission for European Application No. 12857312.8 PCT/US2012/068448 dated Sep. 29, 2015.

(Continued)

*Primary Examiner* — Robert Scruggs

(74) *Attorney, Agent, or Firm* — Hodgson Russ LLP

(57) ABSTRACT

A vacuum cleaner suction head having a housing with a support for movement in the fore-aft direction on a surface. A suction inlet extends through the housing, and has a front edge and a rear edge. A sealing plate is pivotally mounted on the bottom of the housing to rotate about a pivot axis extending in a transverse direction. The sealing plate is movable between a raised position and a lowered position. The sealing plate is mounted in a trailing configuration in which, when the sealing plate is in the lowered position, the pivot axis is at the front of the sealing plate with respect to a fore-aft direction, and a lowermost point on the lower surface of the sealing plate is located behind the pivot axis with respect to the fore-aft direction.

30 Claims, 7 Drawing Sheets

(56) References Cited

U.S. PATENT DOCUMENTS

| | | | | |
|---|---|---|---|---|
| 3,837,038 | A | 9/1974 | Kimzey | |
| 4,642,842 | A | 2/1987 | Hughes | |
| 4,888,850 | A | 12/1989 | Helmes | |
| 5,077,863 | A | 1/1992 | Rench | |
| 5,269,042 | A | 12/1993 | Stephens | |
| 5,317,784 | A | 6/1994 | Glenn, III | |
| 5,347,678 | A | 9/1994 | Williams | |
| 5,701,631 | A | 12/1997 | Lindquist | |
| 6,052,863 | A | 4/2000 | Rittmueller | |
| 6,131,227 | A | 10/2000 | Rief | |
| 6,237,188 | B1 | 5/2001 | Takemoto | |
| 6,385,811 | B1 | 5/2002 | Dilger | |
| 6,581,239 | B1 | 6/2003 | Dyson | |
| 6,591,447 | B2 | 7/2003 | Wegelin | |
| 7,228,592 | B2 | 6/2007 | Hawkins | |
| 7,631,395 | B2 | 12/2009 | Oh | |
| 7,841,046 | B2 | 11/2010 | Fowler | |
| 8,904,595 | B2 * | 12/2014 | Davidshofer | A47L 5/30 15/415.1 |
| 2008/0313846 | A1 | 12/2008 | Steffen | |
| 2009/0000054 | A1 | 1/2009 | Hampton | |
| 2010/0306956 | A1 | 12/2010 | Follows | |
| 2012/0233804 | A1 | 9/2012 | Studebaker | |

OTHER PUBLICATIONS

Office Action for Chinese Application No. CN201280068751.6 dated Sep. 28, 2015.

Communication pursuant to Rules 70(2) and 70a(2) EPC mailed Jun. 26, 2015 for European Application No. 12857312.8.

Extended European Search Report mailed Jun. 9, 2015 for European Application No. 12857312.8.

International Search Report and Written Opinion for PCT/US2012/068448, authorized officer Blaine R. Copenheaver, issued Feb. 19, 2013.

International Preliminary Report on Patentability for International Application No. PCT/US2012/068448, dated Jun. 17, 2014.

* cited by examiner

VACUUM CLEANER FLOOR SEAL

CROSS REFERENCE TO RELATED APPLICATION

This is U.S. Application is a continuation of U.S. application Ser. No. 13/324,498 filed Dec. 13, 2011.

FIELD OF THE INVENTION

The present invention relates to features for use with vacuum cleaners, such as upright vacuum cleaners, commercial vacuums, wet extractors, stick vacuums, canister vacuums, central vacuums, and the like.

BACKGROUND OF THE INVENTION

Vacuum cleaning devices, such as upright and canister vacuum cleaners, wet extractors, stick vacuums, electric brooms and other devices, are in widespread use as tools to clean floors, upholstery, stairs, and other surfaces. Vacuum cleaners typically are expected to operate on various different floor surfaces, such as carpets, hardwood, tiles, and so on. Furthermore, vacuum cleaners typically are expected to be able to remove debris having a wide variety of physical shapes and properties. The debris found in a typical household can include wet substances (e.g., mud and water-soaked hair or dirt), dry particles (e.g., dust and lint), fibers (e.g., hair and carpet fibers) and food particles (e.g., crumbs, popcorn kernels, popped popcorn). Of course, many other kinds of debris could be found in a home. As used herein, terms such as "dirt," "debris" and so on are intended to cover anything that might be desired to be removed from a surface, and are not intended to limit the description or scope of the disclosure in any way.

Manufacturers have endeavored to create vacuum cleaners that can pick up many different kinds of debris from many different floor surfaces. For example, some vacuum cleaners, such as the device shown in U.S. Pat. No. 5,269,042, use variable-height suction inlets that are intended to move close to bare floors, and further away from carpeted floors, which is expected to improve cleaning performance on both surfaces. Such devices may include a brushroll cutoff mechanism to turn off the rotating brush when the device is in the bare floor cleaning position, as it has been found that on bare floors a brush can strike particles and project them away from the suction inlet, resulting in decreased cleaning performance. Other vacuum cleaners include the device shown in U.S. Pat. No. 6,052,863, which has a simple scraper blade located behind the suction inlet which helps prevent dirt from being missed as the inlet is moved forward across a surface, and helps prevent the brushroll from casting away particles. Another vacuum cleaner, shown in U.S. Pat. No. 5,317,784, includes a movable skirt-like brush that lowers towards the floor when the suction inlet is lowered towards a bare floor cleaning position. The foregoing references are incorporated herein by reference.

Prior efforts to provide improved cleaning on various surfaces have not necessarily resulted in a universal cleaning solution that is optimized for all cleaning surfaces. Such prior devices also may be excessively expensive to implement, complicated to use, or not suitable for the dirty environment in which vacuum cleaners operate. It is believed that there still exists a need for improved or alternative vacuum cleaner suction inlet designs.

SUMMARY OF THE INVENTION

In a first exemplary aspect, there is provided a vacuum cleaner suction head having a housing having a fore-aft direction and a transverse direction that is perpendicular to the fore-aft direction, one or more supports connected to the housing to support the housing on a surface to be cleaned for movement generally in the fore-aft direction, a suction inlet having a front edge and a rear edge on a lower surface of the housing, and a sealing plate on the lower surface of the housing. The sealing plates may extend transversely along the front and rear edges of the suction inlet, respectively. The sealing plate is movable relative to the housing between raised and lowered plate positions. In the raised position, the lower surface of the sealing plate is relatively close to the housing. In the lowered position the lower surface of the sealing plate is relatively far from the housing. The sealing is mounted to rotate about a first pivot axis that extends in the transverse direction. The sealing plate is mounted in a trailing configuration in which the first pivot axis is at the front of the sealing plate with respect to the fore-aft direction and lowermost point on the lower surface of the sealing plate is located behind the first pivot axis with respect to the fore-aft direction.

The recitation of this summary of the invention is not intended to limit the claimed invention. Other aspects, embodiments, modifications to and features of the claimed invention will be apparent to persons of ordinary skill in view of the disclosures herein. Furthermore, this recitation of the summary of the invention, and the other disclosures provided herein, are not intended to diminish the scope of the claims in this or any prior or subsequent related or unrelated application.

BRIEF DESCRIPTION OF THE DRAWINGS

The present invention is described in detail with reference to the examples of embodiments shown in the following figures in which like parts are designated by like reference numerals.

DETAILED DESCRIPTION OF EMBODIMENTS OF THE INVENTIONS

The present disclosure provides inventive features for vacuum cleaners, particularly relating to the suction inlet for the air flow path. Embodiments of the inventions described herein may be used with any kind of vacuum cleaner, such as upright vacuums, canister vacuums, stick vacuums, wet extractors, handheld cleaning accessories, central vacuum cleaning heads, and so on. A number of these features and alternative embodiments of the invention are described with reference to their exemplary use in an upright vacuum cleaner, such as the vacuum cleaner 100 shown in FIG. 1. It will be appreciated, however, that the features described herein can be used with vacuum cleaners having different configurations.

Furthermore, the various features described herein may be used separately from one another or in any suitable combination. The present disclosure illustrating the use of the various inventions described herein is not intended to limit the inventions in any way.

Figure 1:
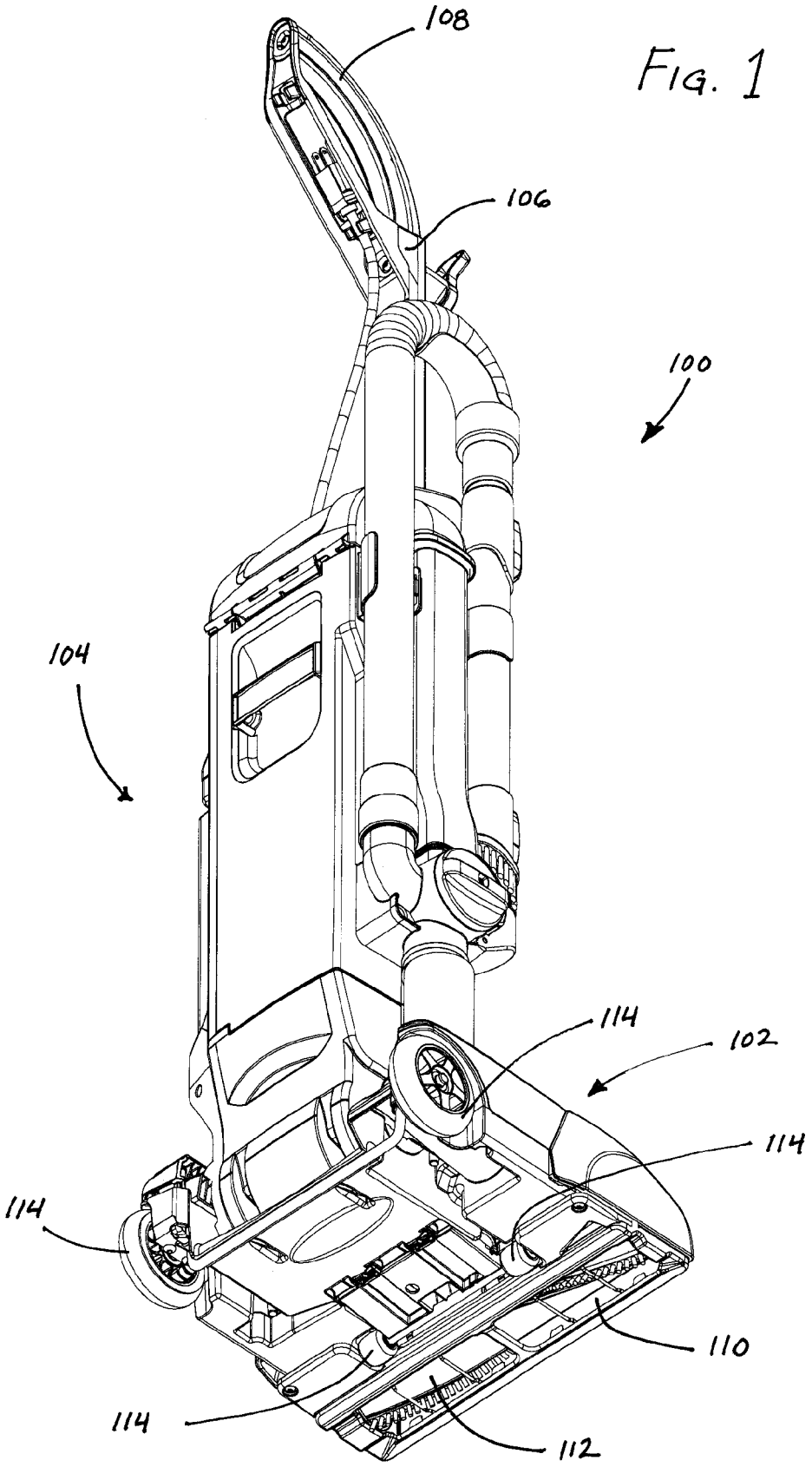
FIG. 1 is a rear isometric view of a prior art vacuum cleaner that may be used with embodiments of the present invention.

FIG. 1 illustrates an exemplary vacuum cleaner 100 that may be used with embodiments of the invention. The vacuum cleaner 100 comprises a suction head 102 to which a rear housing 104 is pivotally mounted. A handle 106 extends upwardly from the rear housing 104 and terminates at a grip 108 that is adapted to be held by an operator to guide the vacuum cleaner 100 during use. The suction head 102 includes a suction inlet 110 that faces the floor or other surface to be cleaned. The suction inlet 110 may be elongated in the transverse direction, which is perpendicular to the fore-aft direction of the vacuum cleaner 100. A rotating or oscillating agitator 112 may be located in the suction inlet 110. The vacuum cleaner 100 includes a vacuum fan (located inside either the suction head 102 or the rear housing 104), such as an impeller driven by an electric motor, or the like. The vacuum cleaner 100 also has a dirt collection system (also located in the suction head 102 or rear housing 104), such as one or more filters (bag, pleated, panel or otherwise), cyclonic separators or the like. The suction head 102 may be supported by one or more supports, such as the illustrated set of two rear wheels 114 and two front wheels 114. The front or rear wheels 114 may be movable relative to the suction inlet 110 to position the suction inlet 110 at various heights relative to the surface upon which the wheels 114 rest. The agitator 112 also may be movable relative to the suction inlet 110, as known in the art. The front or rear wheels 114 may be replaced by skid plates or other supports, as known in the art.

The vacuum cleaner 100 includes a suction flow path that generates an airflow that lifts debris from the floor and removes it from the air. In general, it is desirable to have a high volume of airflow to better lift and remove debris. The airflow is created by generating a negative pressure at the suction inlet 110. In operation, the negative pressure and resulting airflow are generated by the vacuum fan, which is fluidly connected to the suction inlet 110 by one or more ducts or other passages, as known in the art. The moving air enters the suction inlet 110 and flows through the dirt collection system to remove debris from the air. The dirt collection system may comprise one or more elements (filters, bags, cyclones, etc.), which may be upstream and/or downstream of the fan. A typical vacuum cleaner of the foregoing upright variety is disclosed in U.S. Pat. No. 7,228,592, and U.S. Patent Publication Number 2009/0000054, which are incorporated by reference herein. Other vacuums with which embodiments may be used include canisters, such as those shown in U.S. Pat. No. 5,701,631, and U.S. Patent Publication Number 2010/0306955 (also incorporated by reference herein), or any other kind of vacuum cleaner having a suction inlet that is intended to be operated on a floor or other surface.

Figure 2:
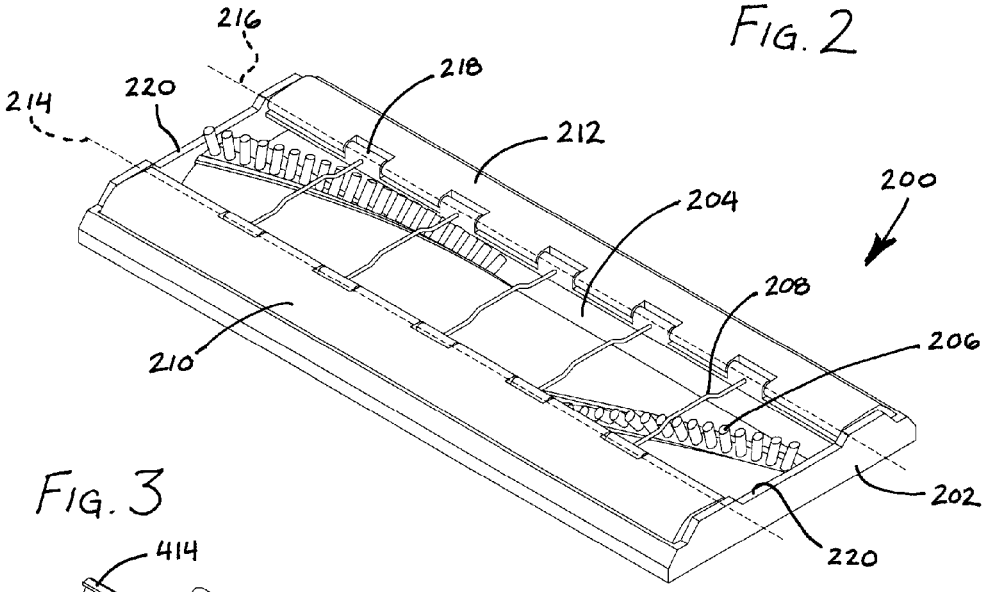
FIG. 2 is an isometric view of a soleplate incorporating an exemplary embodiment of the invention.

Referring now to FIG. 2, a first exemplary embodiment is described. FIG. 2 illustrates a bottom isometric view of a soleplate 200 that may be provided around a suction inlet for a vacuum cleaner, such as the vacuum cleaner 100 of FIG. 100. The soleplate 200 includes a perimeter frame 202 that surrounds a suction inlet 204. For illustration, a brushroll 206 is shown in the suction inlet 204, but it will be appreciated that the brushroll 206 may be a separate part from the soleplate 200. The suction inlet 204 may include a number of guards 208 that span the inlet to help prevent large objects from being pulled into the suction inlet 204, as known in the art.

Figure 3:
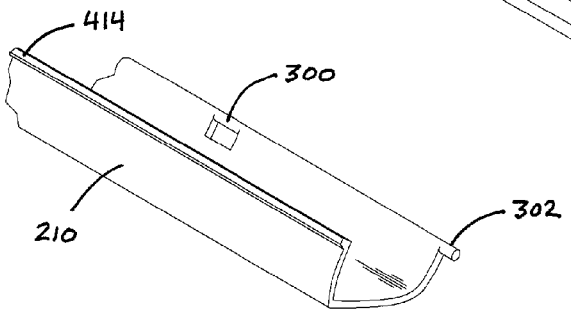
FIG. 3 is a partially cutaway schematic side view of a vacuum cleaner suction head incorporating the embodiment of FIG. 2.

Front and rear sealing plates 210, 212 are mounted on the soleplate frame 202, although it is also contemplated that the soleplate 202 may comprise only a single sealing plate 210 or 212, or be omitted. The sealing plates 210, 212 are pivotally mounted to the frame 202 at respective front and rear pivots 214, 216. Any kind of pivoting attachment may be used to mound the sealing plates 210, 212. An example is shown in FIG. 3, which is a detail of part of the front sealing plate 210 is shown in isometric view in FIG. 3. Here, the pivots 214 may comprise simple cylindrical bosses 300, 302 formed as part of the sealing plate 210. The bosses 300, 302 may be located along the edge of the sealing plate 210 (e.g., boss 300), and may extend from the ends of the sealing plate 210 (e.g., boss 302). The bosses 300, 302 may be integrally formed with the sealing plate 210 or separately formed at attached to the plate 210. The bosses 300, 302 may be mounted in respective supports 218 on the soleplate frame 202. Such supports 218 may comprise cylindrical or semi-cylindrical slots or holes into which the bosses 300, 302 fit. The bosses 300, 302 may be held in place by, for example, forming the supports 218 as clamshell halves and securing them around the bosses 300, 302, or by forming the supports as slotted cylinders into which the bosses 300, 302 fit by snap fitment. There may be any suitable number of pivot mounts for each plate 210, 212. The shown embodiment has seven pivot mounts (including the ones at each end), but it may be desirable to use only two pivot mounts to help reduce or prevent any binding that might occur due to manufacturing tolerance variations or deformations that occur during use that cause the pivots to misalign. Making the plates relatively rigid (e.g., by including a lattice or honeycomb reinforcing structure) may reduce binding issues as well as adding to durability. Reducing the number of pivot mounts also reduces the likelihood of debris clogging the pivots.

It is not necessary for the sealing plates to be as wide as the suction inlet 204. However, as illustrated in the embodiment of FIG. 3, one or both sealing plates 210, 212 may extend along substantially the entire transverse extent of the suction inlet 204 to inhibit airflow generally across the entire transverse width of the suction inlet 204. For example, each the sealing plate 210, 212 may comprise a continuous smooth surface that extends essentially from one lateral end of the suction inlet 204 to the opposite lateral end (the "lateral" direction being perpendicular to the fore-aft direction of the cleaning head). Such a sealing plate 210, 212 may include notches or other periodic interruptions along its transverse extent. A sealing plate 210, 212 having such interruptions still extend along a portion of or along substantially the entire transverse extent of the suction inlet 204. Similarly, the sealing plate 210, 212 may be formed of multiple segments that together extend substantially along the entire transverse extent of the suction inlet 204, but are nonetheless separated by gaps to permit small amounts of airflow or to accommodate mounting bosses or the like.

Figure 4:
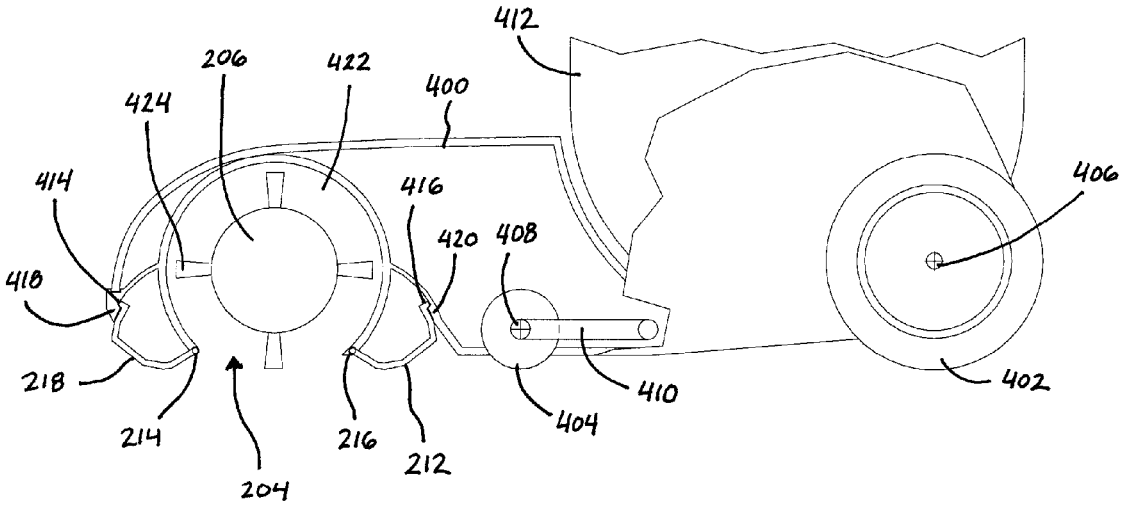
FIG. 4 is an isometric view of a portion of a sealing plate of the embodiment of FIG. 2.

FIG. 4 is a schematic side view illustrating the sealing plates 210, 212 mounted to a vacuum cleaner suction head 400. The suction head 400 may include rear and front support wheels 402,404. Typically, two rear wheels 402 are provided to pivot about a common rear wheel axis 406, but a single rear wheel or more than two rear wheels may be used. Similarly, two front wheels 404 are often provided to pivot on a front wheel axis 408, but it is common to use a single front wheel 404, and more than two wheels can be used as well. The front wheel 404 may be mounted on a movable support 410 by which the front wheel 404 can be raised or lowered with respect to the suction head 400. Exemplary movable supports are shown in U.S. Pat. Nos. 5,269,042, and 7,841,046 and U.S. Patent Publication Number 2008/0313846, which are incorporated herein by reference. Such relative motion pivots the suction head 400 about the rear wheel pivot axis 406, thereby raising and lowering the suction inlet 204 and brushroll 206 relative to the surface to be cleaned. A rear housing 412 (for upright vacuums) or suction wand (for canisters and central vacuums) may be pivotally mounted to the suction head 400, but it may not be necessary to connect the suction head 400 to any other structure (e.g., in autonomous robotic cleaners).

The configuration of support elements that hold the suction head 400 on the surface to be cleaned can be altered as desired. For example, the wheels may mounted on casters that permit rotation through a range of angles. It is also known to use supports other than wheels. For example, smooth skid plates are sometimes used in lieu of front wheels. Other variations may include making the supports fixed (i.e., eliminating the movable support 410), or making the rear wheels movable to raise and lower in the suction inlet 204. It is also known to make the brushroll movable separately from the suction inlet, and to make the suction inlet movable relative to the suction head. These and other configurations may be used with embodiments of the invention.

As shown in FIG. 4, the front sealing plate 210 is mounted in front of the suction inlet 204, and the rear sealing plate 212 is mounted behind the suction inlet 204. The front sealing plate 210 is connected in a leading configuration in which the front pivot 214 is located at the back of the front sealing plate 210. In this leading arrangement, the front sealing plate 210 swings through an arc of travel that is located in front of the front pivot 214. The rear sealing plate 212 is connected in a trailing configuration, in which the rear pivot 216 is located in front of the rear sealing plate 212. In this trailing arrangement, the rear sealing plate 212 swings through an arc of travel that is located behind the rear pivot 216.

Preferably, the front and rear sealing plates 210, 212 are mounted so that they can pivot through limited respective arcs of travel. To this end, the front sealing plate 210 may include a lip 414 that prevents the front sealing plate 210 from dropping below a predetermined point relative to the suction head 400. The rear sealing plate 212 may include a similar lip 416. The lips 414, 416 contact respective catches 418, 420 to prevent movement beyond a predetermined lower point. The upper limit of travel may be similarly limited by contact between the sealing plates 210, 212 and the suction head 400, as will be appreciated from FIG. 4. In this embodiment, the sealing plates 210, 212 are mounted to pivot freely through their respective arcs of travel.

The sealing plates 210, 212 may be immediately adjacent the suction inlet 204 or spaced from the suction inlet 204. In the shown embodiment, the sealing plates 210, 212 are immediately adjacent the suction inlet 204. As shown in FIG. 4, the suction inlet 204 leads directly to a brushroll chamber 422 in which the brushroll 206 is mounted. The brushroll has bristles 424 or other agitators, as known in the art, that can extend below the suction inlet 402 to contact at least some kinds of surfaces over which the suction head 400 travels (e.g., carpets).

Figure 5:
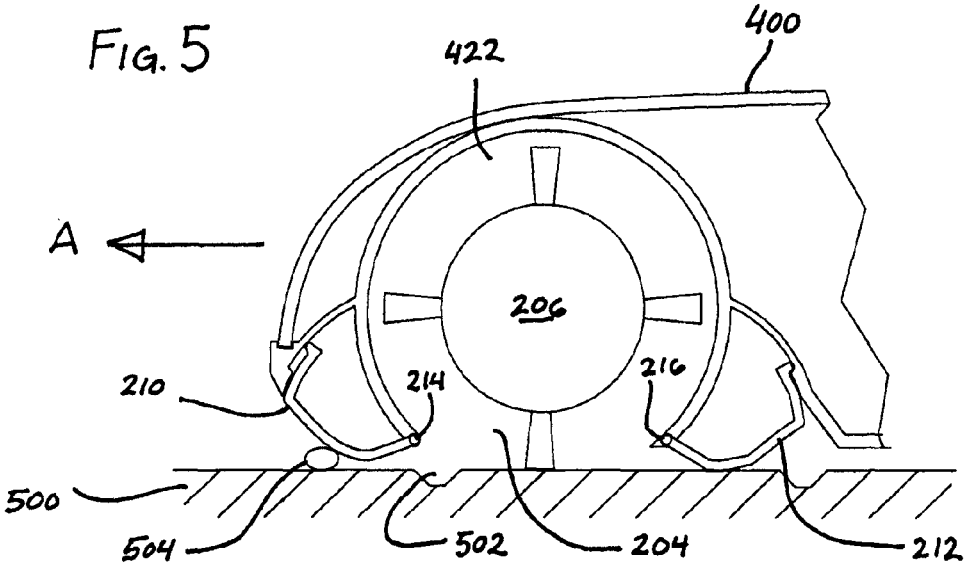
FIG. 5 is a cutaway side view of another embodiment of the invention.
Figure 6:
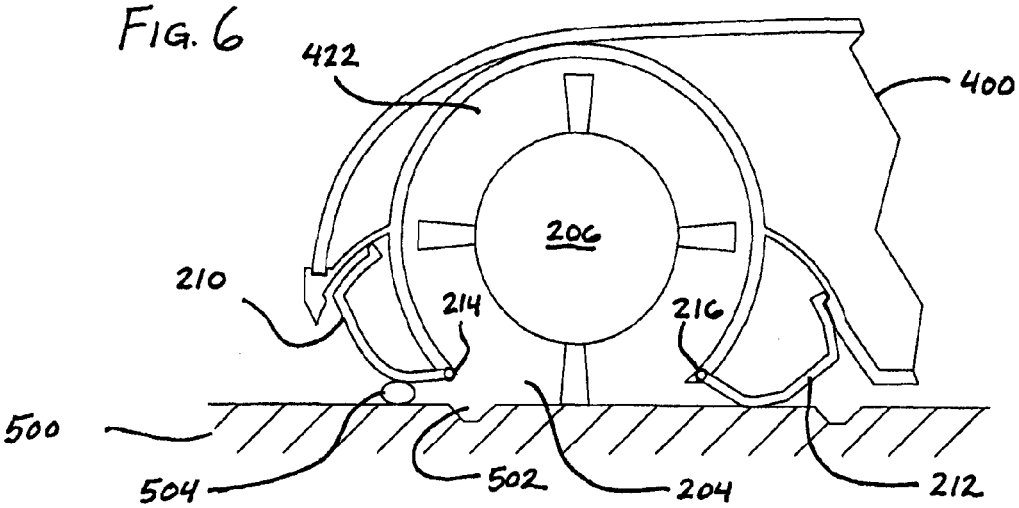
FIG. 6 is a cutaway side view of the embodiment of FIG. 5, shown in an alternate configuration.

Referring now to FIGS. 5-6, an exemplary operation of the sealing plates 210, 212 is illustrated and described. In general terms, the sealing plates 210, 212 are dropped down to create a partial seal around the suction inlet 204 when the suction inlet 204 is positioned close to the floor for cleaning bare floors, carpets with particularly short naps, or other relatively smooth surfaces. This seal is expected to increase the negative pressure at the suction inlet 204 and generate fast-moving airflow around the seal. The fast-moving airflow is expected to be better than relatively slow airflows to remove small, dense particles (e.g., popcorn kernels) and to remove particles that are located in cracks or seams in the floor surface. The sealing plates 210, 212 also may tend to seal the front and rear of the suction inlet 204 and thereby cause the airflow to enter the suction inlet 204 from the sides. Such lateral movement may help convey particles to an opening in the brushroll chamber that leads to the vacuum fan, which opening may be located at the lateral center of the chamber 422 or off to one side. To help obtain this expected benefit, airflow notches 220 may be provided at each lateral side of the soleplate 202 frame (FIG. 2). If desired, notches also may be formed in the sealing plates 210, 212 to permit airflow through them at particular locations.

The height of the suction inlet 204 from the surface 500 may be pre-set or variable. When the suction inlet 204 is in the lowest position (i.e., closest to the surface 500), the front and/or rear sealing plates 210, 212 may have sufficient travel to touch the surface 500, or they may stop just short of the surface 500. In use, the sealing plates 210, 212 generally start in a lowered position such as shown in FIG. 4. In the lowered position, the sealing plates form restrictions that at least partially impede or stop air from flowing beneath them. Furthermore, air that does flow below the sealing plates 210, 212 should accelerate as it passes through the restriction to generate, a localized low pressure area that tends to pull the sealing plates 210, 212 towards the surface 500. Such operation is expected to happen according to the Bernoulli principle of fluid flow, but the invention is not intended to be bound by any theory of operation. If the sealing plates 210, 212 are able to contact the surface 500, the airflow below them may be essentially cut off periodically or for sustained periods during operation of the vacuum cleaner.

During normal cleaning operation, the suction head 400 is moved forward on the surface 500 along the fore-aft direction of the suction head 400, as shown by Arrow A in FIG. 5. As long as there are no objects in the way, the sealing plates 210, 212 are in a lower position towards the surface 500 and the accelerated airflow below and/or around the sealing plates 210, 212 helps remove small particles that pass freely below the front sealing plate 210 or that may be contained in grooves, cracks, seals or other depressions 502 or holes in the surface 500. During this operation, the brushroll 206 or other agitator device may or may not be turned off.

When the suction head 400 encounters an object 504 that does not freely pass under the front sealing plate 210, the pivot 214 permits the sealing plate 210 to move upwards and over the object 504, as shown in FIGS. 5 and 6. As this happens, the gap below the sealing plate 210 opens to permit a greater volume of air to pass below the sealing plate 210, which may help entrain the object 504 in the airflow to pull it into the suction inlet 204. During the time that the front sealing plate 210 is raised, the rear sealing plate 212 may remain in the lowered position to help maintain an air seal along the back of the suction inlet 204. Once the front sealing plate 210 is past the object 504, it falls back to the lowered position.

When the suction head 400 is moved backwards, the rear sealing plate 212 operates similarly to the front sealing plate 210.

In the foregoing embodiment, the sealing plates 210 are freely pivotable relative to be suction head 400, and gravity pulls the sealing plates 210, 212 towards the surface. The weights of the sealing plates 210, 212 may be modified to help control the amount of force necessary to lift them upwards to permit objects to pass below them. It may be desirable to make the sealing plates 210, 212 relatively light so that low-density objects—particularly large low density objects like popped popcorn—can lift and pass under the sealing plates 210, 212 instead of being pushed forward in front of the suction head 400. The location of the pivot points 214, 216 also may be adjusted to affect the ability to admit particles of different sizes and densities under the sealing plates 210, 212. Raising the pivot points 214, 216 is expected to make it easier for large, light objects to elevate and pass under the sealing plates 210, 212. The shape of the sealing plates 210, 212 also may be adjusted to change how the sealing plates 210, 212 react to debris of different sizes and shapes, and plates with sloped shapes are expected to be easier to lift. It is further expected that reducing the angle of the plate surface relative to the floor will make it easier for debris to lift the plate. The surfaces of the sealing plates 210, 212 may include a smooth low-friction layer, or be made from a low-friction material, to help facilitate the movement of objects under them. It is expected that making the plate with lower surface friction than the surface being cleaned will help prevent debris from being pushed along the floor instead of passing under the plate. It also may be desirable to make the plates from a relatively hard material, such as polyamide, polyphenylene sulfide or polycarbonate, to reduce the surface friction characteristics, prevent abrasion and scratching, and increase durability. Other modifications may be made to further adjust the operating characteristics of the sealing plates 210,212.

The embodiment of FIGS. 2-6 has been described, by way of example, as having the sealing plates 210,212 mounted on a soleplate 200, which is then mounted to a vacuum cleaner suction head 400. Such a soleplate 200 may be mounted to the suction head 400 using any suitable attachment mechanism, such as screws or snaps. In other embodiments, the sealing plates 210, 212 may be mounted directly to the suction head 400, rather than being mounted to a soleplate that is mounted on the suction head. In other embodiments, the sealing plates 210, 212 may be captured in place between a soleplate and the suction head. Other arrangements for connecting the soleplates to the suction head also can be used without departing from the spirit and scope of the invention.

Figure 7:
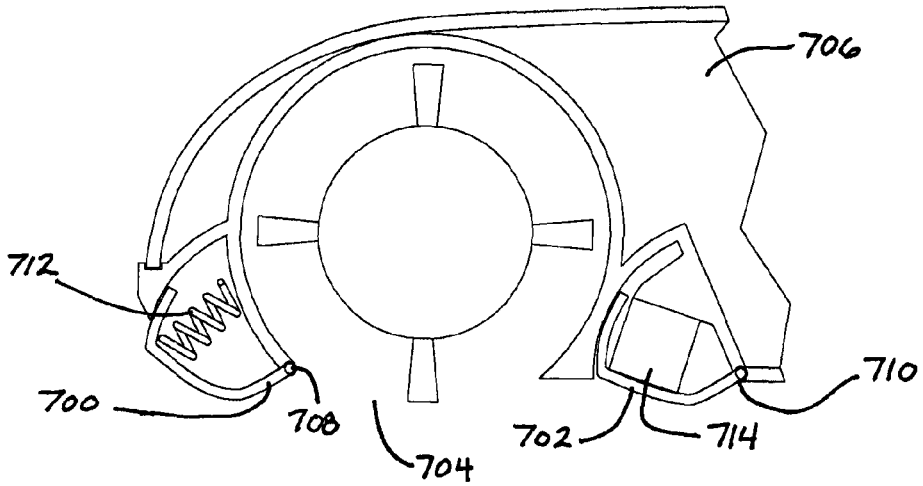
FIG. 7 is a cutaway side view of another embodiment of the invention.

Another embodiment is illustrated in FIG. 7. This embodiment has a front sealing plate 700 and a rear sealing plate 702 that are disposed, respectively, in front of and behind the suction inlet 704 of a suction head 706. In this case, the front and rear sealing plates 700, 702 are both mounted in a leading arrangement, with their pivots 708, 710 at the fronts of the plates 700, 702. Also, this embodiment includes front and resilient members 712, 714 that bias the sealing plates 700,702 downwards towards the surface being cleaned. The resilient members 712,714 are shown as a coil spring (712) and a foam block (714), they may comprise any kind of biasing member, such as an elastomeric block, leaf springs, or a living hinge formed on either the suction head 706 of the sealing plates 700,702. It is expected that blocks of an open-cell foam, such as two ¼-inch to ½-inch blocks of polyurethane foam (per plate) having about 30 to about 90 pores per inch, might provide a light restoring force that gently biases the sealing plates 700,702 towards the floor, without creating such a large force that large lightweight objects can not move the sealing plates 700, 702 upwards to be ingested by the vacuum cleaner. Biasing elements such as springs may be provided with only one of the sealing plates 700,702. For example, in one embodiment only the rear sealing plate 702 may have a resilient member to bias it downward and in another embodiment only the front sealing plate 700 may have a resilient member to bias it downward. While front and rear leading sealing plates in the leading configuration are shown in conjunction with biasing members in FIG. 7, this is for illustration only, and it will be understood that these features may be used separately in other embodiments and in configurations in which the sealing plates have different mounting configurations.

Figure 8:
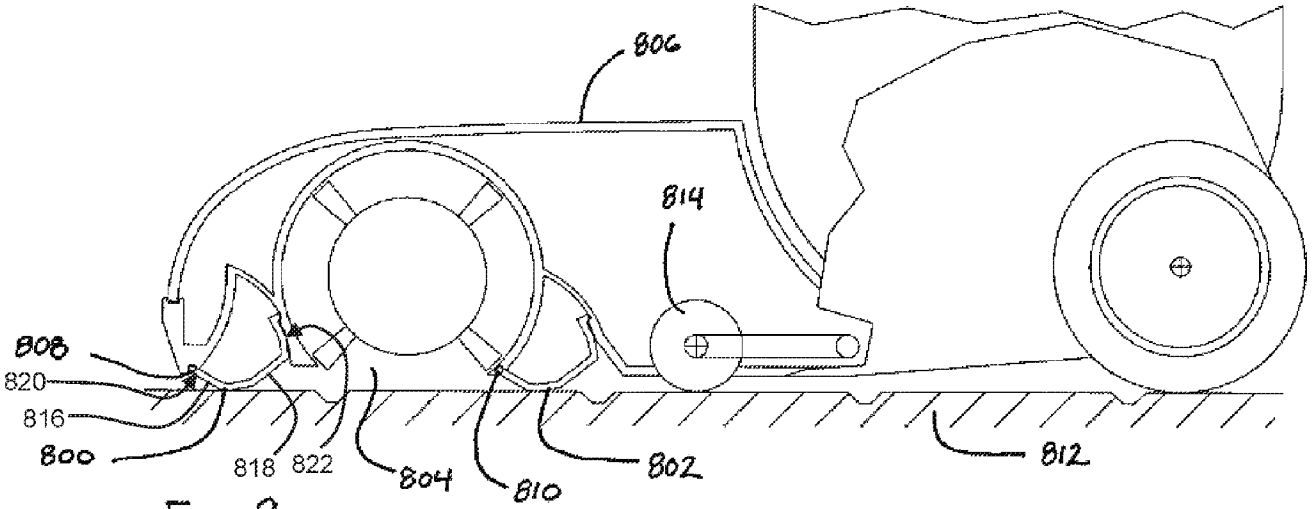
FIG. 8 is a partially cutaway schematic side view of another embodiment of the invention.
Figure 9:
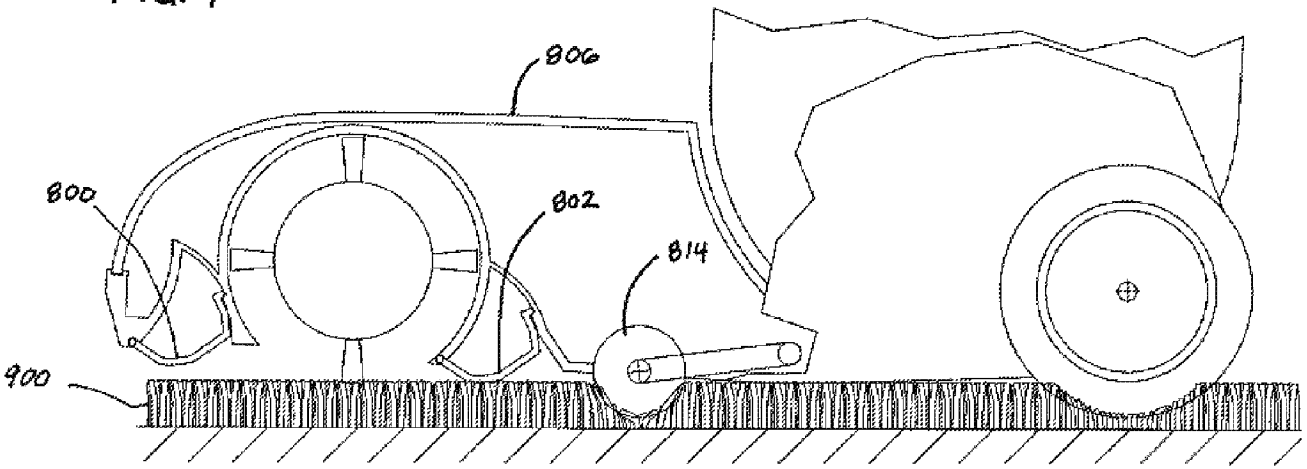
FIG. 9 is a partially cutaway schematic side view of the embodiment of FIG. 8, shown in an alternate configuration.

Another embodiment is illustrated in FIGS. 8 and 9. This embodiment includes front and rear sealing plates 800, 802 that are disposed, respectively, in front of and behind the suction inlet 804 of a suction head 806. The front and rear sealing plates 800, 802 are both mounted in a trailing arrangement, with their pivots 808, 810 at the fronts of the plates 800, 802. The front sealing plate 800 comprises a first sloped surface 816 extending from the pivot 808 to a lowermost point on the front sealing plate 800, and a second sloped surface 818 extending from the lowermost point to the suction head 806 housing. A first region 820 of the first sloped surface 816 is adjacent to the suction head 806 housing, and a second region 822 of the second sloped surface 818 is adjacent to the suction head 806 housing. It is believed that this embodiment will provide particularly good performance at permitting large but light debris to lift the front plate 800 to enter the suction inlet 804 (as opposed to simply pushing the debris ahead of the front plate 800). It has been found that sealing plates mounted in the trailing arrangement tend to resist upward movement less than those mounted in the leading arrangement. Without being bound by any theory of operation, it is believed that this is a result of the balance between the force vectors that are generated when the plate contacts the debris. In a trailing configuration, the force vector perpendicular to the plate surface and the friction force vector that is parallel to the plate surface both may generate moments that tend to raise the plate.

Whereas in the leading configuration, the force vector perpendicular to the plate surface may generate a moment that tends to raise the plate, but the friction force vector parallel to the plate surface may generate a moment that tends to lower the plate.

As shown in FIG. 8, the front and rear sealing plates 800, 802 may be close to or in contact the surface being cleaned 812. However, the suction head 806 may include a movable support, such as a front wheel 814 that lifts the sealing plates 800,802 relative to the surface.

Any of a plurality of suitable movable supports, well-known in the art, may be used. When the suction head 806 is elevated, the sealing plates 800, 802 may not contact the surface 812. In addition, one or both sealing plates 800, 802 may be elevated enough that they do not contact even high carpet piles 900, as shown in FIG. 9. In this embodiment, the front sealing plate 800 clears the carpet piles 900, but the rear sealing plate 802 remains in contact with the piles 900. Further elevation of the suction head 806 may take the rear sealing plate 802 out of contact with the piles 900. Alternatively, the sealing plates 800, 802 may be positioned and given sufficient vertical travel to remain in contact with the carpet piles 900 regardless of the position of the movable support 801.

It is expected that the sealing plates can be configured to provide enhanced cleaning on bare floors, particularly floors having grooves or grout lines or the like, and also operate without detriment—and possibly with enhanced performance—on various levels of carpet without needing adjustment. To obtain more consistent performance at various levels of carpet, it may be desirable to provide the sealing plates with sufficient vertical travel to contact the carpet regardless of the level of elevation of the suction inlet relative to the floor.

Under certain circumstances, it may be desirable to lift the sealing plates so that they no longer move towards the surface being cleaned. For example, where it is desirable to vacuum large, light particles that do not have sufficient mass to elevate the sealing plates, it may be desirable to manually lift the sealing plates away from the surface being cleaned to permit such particles to move into the suction inlet. It also may be desirable to move the sealing plates out of the way when vacuuming carpets, which may help prevent the sealing plates from blocking the airflow entering the suction inlet.

Figure 10:
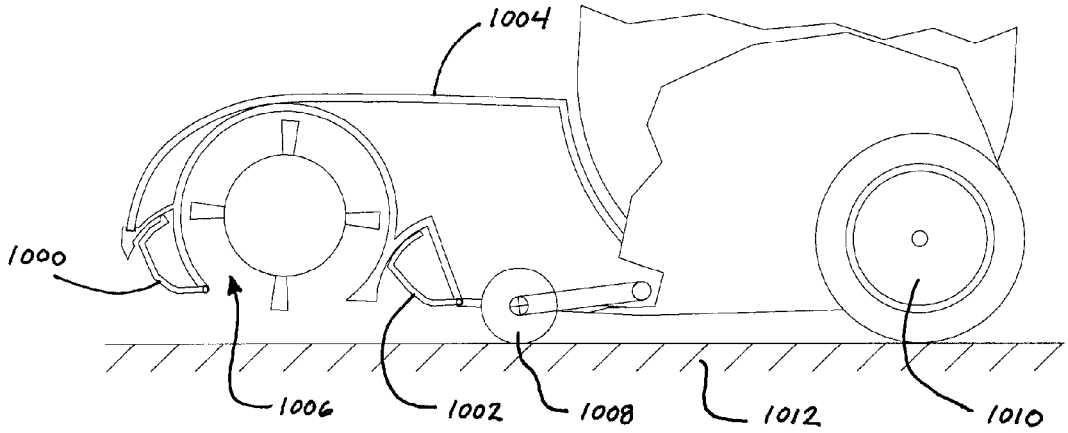
FIG. 10 is a partially cutaway schematic side view of another embodiment of the invention.
Figure 11:
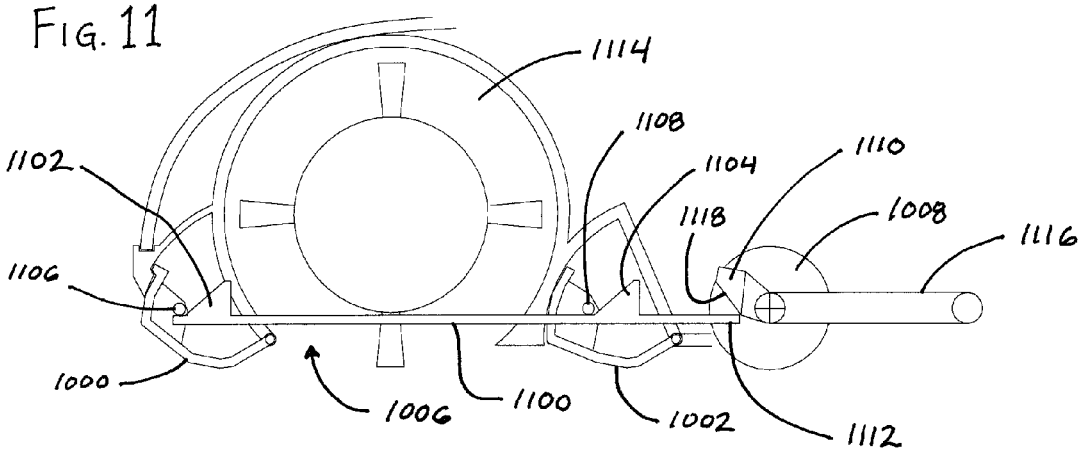
FIG. 11 is a cutaway schematic view of the embodiment of FIG. 10, shown in a first configuration.
Figure 12:
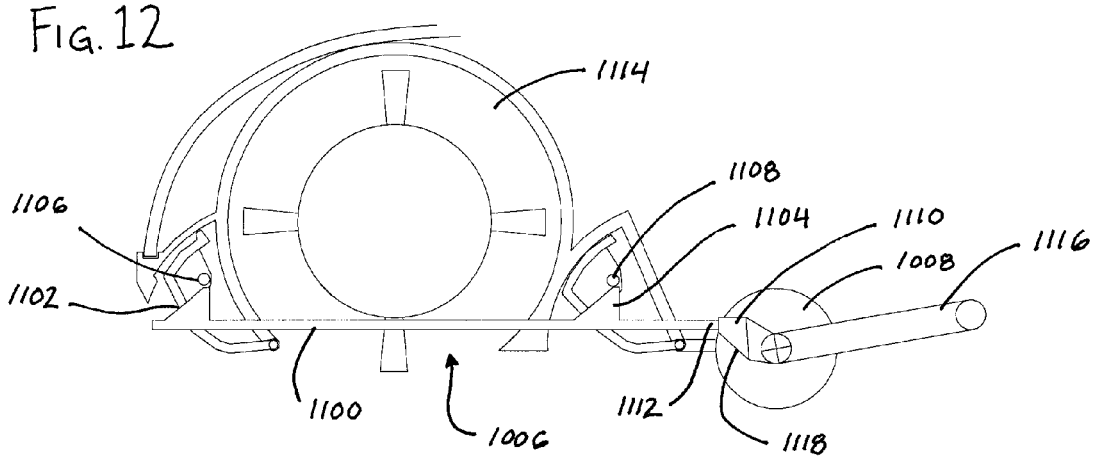
FIG. 12 is a cutaway schematic view of the embodiment of FIG. 10, shown in a second configuration.

FIGS. 10 to 12 show one exemplary embodiment having front and rear sealing plates 1000, 1002 that are movable to an elevated position in the suction head 1004. In this embodiment, the sealing plates 1000, 1002 are located in front of and behind a suction inlet 1006. The sealing plates 1000, 1002 may be mounted in the leading and/or trailing arrangements with respect to their pivot axes, such as described previously herein. The suction head 1004 is supported by one or more front wheels 1008, and one or more rear wheels 1010, with the front wheels 1008 being movable relative to the suction head 1004 to adjust the height of the suction inlet 1006 relative to the surface 1012 being cleaned. Although wheels are shown as the support members, other kinds of support (e.g., skids, casters, spherical rollers, etc.) may alternatively be used. Any type of mechanism can be used to move the front (or rear) support to raise and lower the suction inlet 1005.

Referring more specifically to FIGS. 11 and 12, this embodiment includes a plate lifter for raising one or both sealing plates 1000, 1002. The plate lifter comprises a pushrod 1100 having a pair of ramps 1102, 1104 located proximal to the front and rear sealing plates 1000, 1002. Each sealing plate 1000, 1002 has a respective post 1106, 1108 extending laterally therefrom. When the pushrod 1100 is moved in the forward direction, each ramp 1102, 1104 contacts a respective post 1106, 1108, thereby rotating the posts 1106, 1108 and their respective sealing plates 1000, 1002 upwards about their respective pivots. FIG. 11 shows the sealing plates 1000, 1002 in the lower position, and FIG. 12 shows the sealing plates 1000, 1002 in the raised position.

Any suitable mechanism may be used to move the pushrod 1100. In this embodiment, a cam 1110 is mounted to the movable support 1116 that raises and lowers the front wheel 1008. When the movable support 1116 is lowered to push down the front wheel 1008 and thereby raise the suction inlet 1006 relative to the surface 1012, the cam 1110 moves downward relative to the pushrod 1100. The end of the cam has a ramped cam surface 1118 that slides against the end 1112 of the pushrod 1100, and generates a force to move the pushrod 1100 forward. Thus, when the front wheel 1008 is lowered to elevate the suction inlet, the sealing plates 1000, 1002 are raised upwards relative to the suction inlet 1106.

It will be understood that other mechanisms may be used to raise the sealing plates, and it is not required in all embodiments to associate the operation of this mechanism with movement of a wheel support or any other device that elevates or lowers the suction inlet relative to the surface being cleaned. For example, an alternative mechanism may comprise levers or cables that lift the sealing plates. As another example, a pushrod such as described above may be operated by a manual switch that can be activated whenever the user desires to move the sealing plates out of the way. The mechanism also may be operated when the suction inlet is lowered close to the surface. For example, the vacuum cleaner may be configured to provide two operating modes when the suction inlet is at its lowest position: one in which the sealing plates are allowed to fall towards the surface, and one in which they are raised. Other configurations may be used as desired. Still another embodiment may include a plate lifter that lifts only the front sealing plate or only the rear sealing plate, or lifts them selectively depending on the user preference or direction of movement. For example, the plate lifter may only raise the front sealing plate, so as to permit large particles to enter the suction inlet, while leaving the rear sealing plate down to prevent the escape of particles behind the suction inlet.

For simplicity of illustration, the mechanism in FIGS. 11 and 12 is shown superimposed on the brushroll chamber 1114. However, the mechanism may be located to one side of the brushroll chamber 1114 (i.e., on the left or right side with respect to the fore-aft direction of the vacuum cleaner), or configured to wrap around the brushroll chamber 1114 (e.g., by arching the central portion of the pushrod 1100 over the top of the chamber 1114). It may be desirable to locate the mechanism outside the brushroll chamber 1114 so that it does not interfere with cleaning, and does not become clogged with debris being drawn through the suction inlet 1106.

Figure 13:
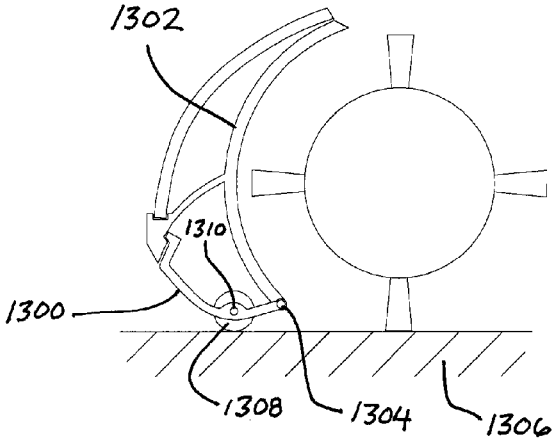
FIG. 13 is a cutaway side view of another embodiment of the invention.
Figure 14:
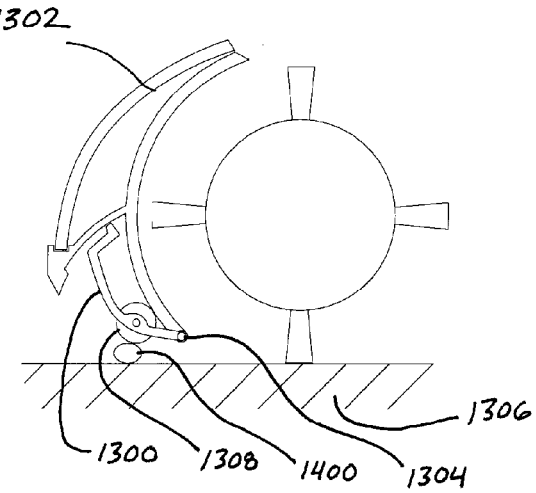
FIG. 14 is a an alternate view of the embodiment of FIG. 13.

Another embodiment is illustrated in FIGS. 13 and 14. This embodiment provides a sealing plate 1300 that is mounted to a vacuum cleaner suction head 1302 by a pivot 1304. The plate 1300 and pivot 1304 are shown in a leading configuration, but a trailing configuration may instead be used. In this embodiment, the sealing plate 1300 is supported on the surface 1206 being cleaned by one or more rollers 1308. The rollers 1308 may comprise hard or resilient plastic, wood, or other suitable materials. Simple pins 1310 or bushings may be used to mount the rollers 1308 to the sealing plate 1300. The rollers 1308 may span the majority of the width of the sealing plate 1300, or may be located at discrete locations, such as at each end of the sealing plate 1300. It may be desirable to make the rollers 1308 as narrow as possible to reduce friction on the bearing surfaces that mount them to the plates.

As noted, the rollers 1308 support the sealing plate 1300 on the surface 1306. The rollers 1308 may hold the bottom surface of the sealing plate 1300 at a discrete distance from the surface 1306, as shown. This distance will depend on the distance from the outer radius of the roller 1308 from the bottom surface of the sealing plate 1300. If the outer radius of the roller 1308 is nearly flush with the bottom surface of the sealing plate 1300 it will hold the sealing plate 1300 very close to the surface 1306, but making the radius of the roller 1308 extend past the bottom surface of the sealing plate 1300 will hold the sealing plate 1300 further from the surface 1306 being cleaned. Nominal distances in the range of about 0.04 to about 0.39 inches (−1 to −10 mm) are expected to be useful. It will be understood that the actual distance may vary if the surface or the sealing plate is not perfectly flat.

It is expected that adding one or more rollers 1308 to the sealing plate 1300 may help prevent friction with the surface 1306 being cleaned. Holding the sealing plate 1300 at a fixed distance from the surface 1306 also may help generate a more predictable and enhanced airflow beneath the sealing plate 1300, and prevent the sealing plate 1300 from contacting the surface 1306 and cutting off the airflow entirely (at least momentarily). In operation, particles 1400 may pass under the sealing plate 1300, either by passing between the rollers 1308, or by passing under the rollers 1308 (as shown).

Figure 15:
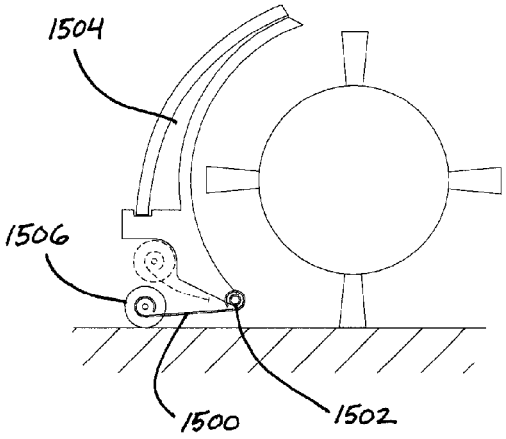
FIG. 15 is a cutaway side view of another embodiment of the invention.
Figure 16:
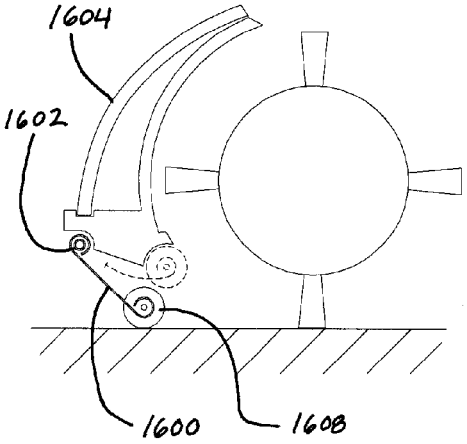
FIG. 16 is a cutaway side view of another embodiment of the invention.

Two similar additional embodiments are illustrated in FIGS. 15 and 16. FIG. 15 illustrates an embodiment of a sealing plate 1500 that is formed as a flexible ribbon of material, such as thin plastic or metal. The sealing plate 1500 is mounted at a first end 1502 to the vacuum cleaner suction head 1504, and at a second end the sealing plate 1500 may include one or more rollers 1506, such as described above. The first end 1502 may be wrapped around a pin on the suction head 1504 and pivotable, in which case the sealing plate 1500 will operate much like the foregoing embodiments. Alternatively, the first end 1502 may be cantilevered in the suction head 1504, such as by fitting a bent lip at the first end 1502 into a slot on the suction head 1504. In this latter embodiment, the sealing plate 1500 itself will flex to allow debris to pass beneath it. The dashed lines show how the sealing plate 1500 might flex when it encounters a piece of debris.

FIG. 16 is similar to FIG. 15, and shows a sealing plate 1600 that is mounted at a first end 1602 to a vacuum cleaner suction head 1604, and at a second end has a roller 1606. In this case, the sealing plate 1600 is mounted in the trailing configuration.

Figure 17:
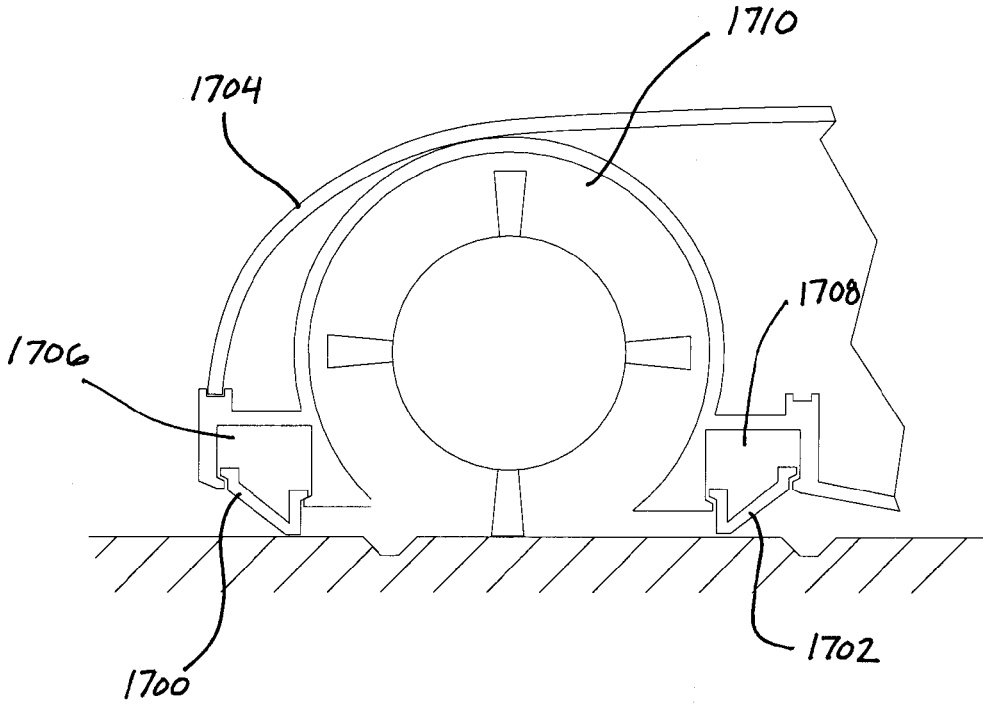
FIG. 17 is a cutaway side view of another embodiment of the invention.

FIG. 17 illustrates another embodiment, in which front and rear sealing plates 1700, 1702 are movably mounted to a vacuum cleaner suction head 1704. In this embodiment, the sealing plates 1700, 1702 are slidable relative to the suction head 1704, instead of being pivotally mounted as in previous embodiments. The sealing plates 1700, 1702 are mounted in respective chambers 1706, 1708 that constrain the movement of the sealing plates 1700, 1702 to the substantially vertical direction. However, movement at inclined angles may alternatively be used in other embodiments. For example, the front sealing plate 1700 may be mounted to slide at an angle that leans towards the brushroll chamber 1710, so that less force is required to push the sealing plate 1700 against friction. Any suitable arrangement of tracks, guides and low-friction surfaces may be used to slidingly mount the sealing plates 1700, 1702.

The present disclosure describes a number of new, useful and nonobvious features and/or combinations of features that may be used alone, together, with upright vacuum cleaners, canister vacuum cleaners or other types of cleaning device, or in other ways. The embodiments described herein are all exemplary, and are not intended to limit the scope of the inventions in any way. It will be appreciated that the inventions described herein can be modified and adapted in various ways and for different uses. For example, embodiments may have a single sealing plate located on either the front or the back of the suction inlet, or sealing plates may be located along the sides of the suction inlet. Also, the front and rear sealing plates may be formed as a single piece that moves relative to the suction inlet. These and other modifications and adaptations will be appreciated by persons of ordinary skill in the art in view of the present disclosure, and all such modifications and adaptations are included in the scope of this disclosure and the appended claims.

We claim:

1. A vacuum cleaner suction head comprising:

a housing having a lower surface configured to face a surface to be cleaned, a fore-aft direction, and a transverse direction that is perpendicular to the fore-aft direction;

one or more supports connected to the housing to support the housing for movement in the fore-aft direction on the surface to be cleaned;

a suction inlet extending through the lower surface of the housing, the suction inlet having a front edge and a rear edge located behind the front edge in relation to the fore-aft direction;

a first plate pivotally mounted at the lower surface of the housing to rotate about a first pivot axis extending in the transverse direction, the first plate being movable relative to the housing between a raised first plate position in which a lower surface of the first plate is relatively close to the housing, and a lowered first plate position in which the lower surface of the first plate is relatively far from the housing; and wherein the first plate is mounted in a trailing configuration in which the first pivot axis is in front of the first plate with respect to the fore-aft direction and a lowermost point on the lower surface of the first plate is located behind the first pivot axis with respect to the fore-aft direction.

2. The vacuum cleaner suction head of claim 1, wherein the first plate is adjacent the front edge of the suction inlet and is movable to rotate about the first pivot axis in a direction towards the suction inlet from the lowered plate position to the raised first plate position by contact with debris on the surface to be cleaned.

3. The vacuum cleaner suction head of claim 1, wherein the lower surface of the first plate comprises a first surface that extends from the first pivot axis to the lowermost point on the lower surface of the first plate, and a second surface that extends from the lowermost point on the lower surface of the first plate to a point adjacent the lower surface of the housing.

4. The vacuum cleaner suction head of claim 3, wherein:

the first surface comprises a first region that remains adjacent the lower surface of the housing throughout the range of movement of the first plate from the lowered first plate position to the raised first plate position; and the second surface comprises a second region that remains adjacent the lower surface of the housing throughout the range of movement of the first plate from the lowered first plate position to the raised first plate position.

5. The vacuum cleaner suction head of claim 3, wherein the second surface of the first plate includes a lip that contacts a catch on the housing when the plate is in the lowered first plate position to prevent the first plate from moving below the lowered first plate position.

6. The vacuum cleaner suction head of claim 1, wherein the first plate includes a first contact surface that contacts a second contact surface on the housing when the first plate is in the lowered first plate position to prevent the first plate from moving below the lowered first plate position.

7. The vacuum cleaner suction head of claim 1, wherein the first plate is adjacent the rear edge of the suction inlet.

8. The vacuum cleaner suction head of claim 1, wherein the suction inlet is fluidly connected to a brushroll chamber and a brushroll is rotatably mounted in the brushroll chamber.

9. The vacuum cleaner suction head of claim 1, wherein the suction inlet is elongated in the transverse direction.

10. The vacuum cleaner suction head of claim 1, wherein the first plate is biased from the raised first plate position to the lowered first plate position solely by gravity.

11. The vacuum cleaner suction head of claim 1, wherein the first plate is biased from the raised first plate position to the lowered first plate position by one or more resilient members or springs.

12. The vacuum cleaner suction head of claim 1, wherein the plate comprises at least one roller rotatably mounted to the first plate, the roller extending below the lower surface of the first plate to contact the surface to be cleaned.

13. The vacuum cleaner suction head of claim 12, wherein the roller extends below the lower surface of the first plate by a distance of about 0.04 inches to about 0.39 inches.

14. The vacuum cleaner suction head of claim 12, wherein the first plate extends in the transverse direction between opposite ends of the first plate, and the at least one roller comprises a roller located at each end of the first plate.

15. The vacuum cleaner suction head of claim 1, further comprising a plate lifter operatively associated with the housing and the first plate, the plate lifter having a first position in which it allows the first plate to move to the lowered first plate position, and a second position in which it holds the first plate in the raised first plate position.

16. The vacuum cleaner suction head of claim 15, wherein the plate lifter comprises a ramp that is movable relative to the housing to lift the first plate from the lowered first plate position to the raised first plate position.

17. The vacuum cleaner suction head of claim 15, wherein:

at least one of the supports is movable with respect to the housing to selectively position the suction inlet between a lowered suction inlet position in which the suction inlet is proximal to the surface to be cleaned, and a raised suction inlet position in which the suction inlet is distal from the surface to be cleaned; and wherein the plate lifter is configured to lift the first plate to the raised first plate position when the suction inlet is in the raised suction inlet position.

18. The vacuum cleaner suction head of claim 15, wherein:

at least one of the supports is movable with respect to the housing to selectively position the suction inlet between a lowered suction inlet position in which the suction inlet is proximal to the surface to be cleaned, and a raised suction inlet position in which the suction inlet is distal from the surface to be cleaned; and wherein the plate lifter is configured to lift the first plate to the raised first plate position when the suction inlet is in the lowered suction inlet position.

19. The vacuum cleaner suction head of claim 1, wherein the supports comprise wheels.

20. The vacuum cleaner suction head of claim 1, further comprising a second plate pivotally mounted at the lower surface of the housing to rotate about a second pivot axis extending in the transverse direction, the second plate being movable relative to the housing between a raised second plate position in which a lower surface of the second plate is relatively close to the housing, and a lowered second plate position in which the lower surface of the second plate is relatively far from the housing.

21. The vacuum cleaner suction head of claim 20, wherein the first plate is adjacent the front edge of the suction inlet, and the second plate is adjacent the rear edge of the suction inlet.

22. The vacuum cleaner suction head of claim 20, wherein the second plate is mounted in a trailing configuration in which the second pivot axis is in front of the second plate with respect to the fore-aft direction and a lowermost point on the lower surface of the second plate is located behind the second pivot axis with respect to the fore-aft direction.

23. The vacuum cleaner suction head of claim 1, wherein the first plate is adjacent the front edge of the suction inlet.

24. The vacuum cleaner suction head of claim 1, wherein the first plate is connected to the housing by a first boss extending from a first end of the first plate, and a second boss extending from a second end of the first plate.

25. The vacuum cleaner suction head of claim 1, wherein the housing comprises a sole plate having a perimeter frame surrounding the suction inlet, and the first plate is mounted to the sole plate.

26. The vacuum cleaner suction head of claim 1, wherein the first plate comprises a sloped surface extending towards the housing from the lowermost point on the lower surface of the first plate.

27. The vacuum cleaner suction head of claim 26, wherein the sloped surface extends upwards and from behind the lowermost point on the lower surface of the first plate, with the lowermost point between the sloped surface and the suction inlet.

28. A vacuum cleaner suction head comprising:

a housing having a lower surface configured to face a surface to be cleaned, a fore-aft direction, and a transverse direction that is perpendicular to the fore-aft direction;

one or more supports connected to the housing to support the housing for movement in the fore-aft direction on the surface to be cleaned;

a suction inlet extending through the lower surface of the housing and fluidly connected to a brushroll chamber, the suction inlet having a front edge and a rear edge located behind the front edge in relation to the fore-aft direction and being elongated in the transverse direction;

a first plate mounted at the lower surface of the housing adjacent the rear edge of the suction inlet, the first plate being movable relative to the housing between a raised first plate position in which a lower surface of the first plate is relatively close to the housing, and a lowered first plate position in which the lower surface of the first plate is relatively far from the housing; and wherein the first plate comprises:

a lowermost point, a sloped surface extending towards the housing from behind the lowermost point on the lower surface of the first plate, with the lowermost point between the sloped surface and the suction inlet, and a first contact surface that contacts a second contact surface on the housing when the first plate is in the lowered first plate position to prevent the first plate from moving below the lowered first plate position.

29. The vacuum cleaner suction head of claim 28, wherein the first plate is pivotally mounted to rotate about a first pivot axis in a trailing configuration in which the first pivot axis is in front of the first plate with respect to the fore-aft direction and a lowermost point on the lower surface of the first plate is located behind the first pivot axis with respect to the fore-aft direction.

30. The vacuum cleaner suction head of claim 28, wherein the first plate is slidably mounted to the housing.

* * * * *